United States Patent [19]

Kahn

[11] 4,373,115

[45] Feb. 8, 1983

[54] PREDICTIVE DISTORTION REDUCTION IN AM STEREO TRANSMITTERS

[76] Inventor: Leonard R. Kahn, 137 E. 36th St., New York, N.Y. 10016 .

[21] Appl. No.: 179,327

[22] Filed: Aug. 18, 1980

[51] Int. Cl.[3] ..... H04H 5/00

[52] U.S. Cl. ..... 179/1 GS; 332/17; 332/37 D; 455/126

[58] Field of Search ..... 179/1 GS; 332/17, 18, 332/21, 22, 37 R, 37 D, 40, 41; 455/126

[56] References Cited

U.S. PATENT DOCUMENTS

| | | | |
|---|---|---|---|
| 2,033,136 | 3/1936 | Ferrell | 179/171 |
| 2,085,125 | 6/1937 | Shaw | 250/17 |
| 2,159,020 | 5/1939 | Ferrell | 179/171 |
| 3,068,475 | 12/1962 | Avins | 343/200 |
| 3,085,203 | 4/1963 | Logan et al. | 325/50 |
| 4,147,985 | 4/1979 | Rogers | 325/144 |
| 4,181,889 | 1/1980 | Davis | 325/124 |
| 4,225,751 | 9/1980 | Hershberger | 179/1 GS |

OTHER PUBLICATIONS

"Polar-Loop Transmitter", Electronics Letter, May 10, 1979, vol. 15, No. 10, pp. 286-288.

*Primary Examiner*—Douglas W. Olms

*Attorney, Agent, or Firm*—Edward A. Onders; Frank R. Agovino

[57] ABSTRACT

An apparatus for generating a composite AM stereo broadcast signal wherein a carrier is angle modulated with stereo difference information contained in a first supplied signal and the angle-modulated carrier is then amplitude modulated with stereo sum information contained in a second supplied signal, an improvement wherein distortion is predicted by the use of a simulated transmitter and receiver to generate a correction signal having distortion representative components. Correction signals developed in this manner are used to modify the angle-modulated signal utilizing a feedback technique, a subtractive technique, or both, thereby reducing distortion in the output of the stereo difference signal channel of actual AM stereo receivers which receive said composite AM stereo signal.

13 Claims, 5 Drawing Figures

PREDICTIVE DISTORTION REDUCTION IN AM STEREO TRANSMITTERS

BACKGROUND OF THE INVENTION

The present invention relates generally to transmitters for AM stereo radio broadcasting systems and, in particular, to techniques for reducing distortion by modifying the stereo signal encoding and multiplex modulation portion of such transmitters.

In AM stereo radio broadcasting systems a signal component representative of the sum of left (L) and right (R) input stereo audio signals ($L_T+R_T$) is amplitude modulated on a carrier. A second signal component, representative of the difference between the L and R signals ($L_T-R_T$) is multiplex modulated on the same carrier, using phase or frequency modulation techniques. The ($L_T+R_T$) component is equivalent to monophonic information, whereas the ($L_T-R_T$) component conveys the stereophonic information. When both components are recovered in an AM stereo receiver they may be combined in such a way as to develop two output audio signals $L_R$ and $R_R$ which are representative of the original L and R stereo input signals that were supplied to the transmitter.

To insure accurate stereo reproduction in AM stereo receivers it is, of course, desirable to have $L_T=L_R$ and $R_T=R_R$. However, distortion may result from various causes in the transmitter (including its antenna system), during propagation from the transmitter to the receiver, and in the receiver itself. It is desirable, therefore, to reduce such distortion in order to improve the accuracy of stereo reproduction at the receiver.

Although prior art techniques have been effective in reducing distortion introduced in AM stereo transmitters to levels which have been found to be acceptable in actual listening tests, nevertheless, it would be desirable if distortion in AM stereo transmission and reception could be reduced even further.

For example, with respect to the basic independent sideband (ISB) AM stereo system disclosed in the inventor's U.S. Pat. No. 3,218,393, the improvement disclosed in the inventor's U.S. Pat. No. 3,908,090 reduces certain distortion which was present in the basic system.

SUMMARY OF THE INVENTION

The present invention relies on one, or both, of two techniques that are applied in the multiplex modulation (or L−R) channel of an AM stereo transmitter to reduce distortion to very low levels. In accordance with one aspect of the invention, distortion is predicted and reduced by developing distortion cancelling components which are subtractively combined with the basic stereo difference signal in the multiplex modulation channel. In accordance with a second aspect of the invention a novel feedback arrangement incorporating distortion prediction is employed to reduce distortion in the overall multiplex modulation channel. Although each technique is effective alone in reducing distortion, they are particularly effective when utilized together.

It is, therefore, an object of the present invention to provide improved AM stereo transmitters having less distortion in the multiplex modulation channel than prior art transmitters.

It is another object of the present invention to provide methods and apparatus for reducing distortion to very low levels in the multiplex modulation channel of AM stereo transmitters.

It is still a further object of the present invention to provide two different predictive techniques for distortion reduction in the multiplex modulation channel of AM stereo transmitters, which techniques, when used together, provide substantial distortion reduction and practical benefits in implementation.

For a better understanding of the present invention, together with other and further objects thereof, reference is made to the following description, taken in conjunction with the accompanying drawings, and its scope will be pointed out in the appended claims.

DESCRIPTION OF THE INVENTION

Figure 1:
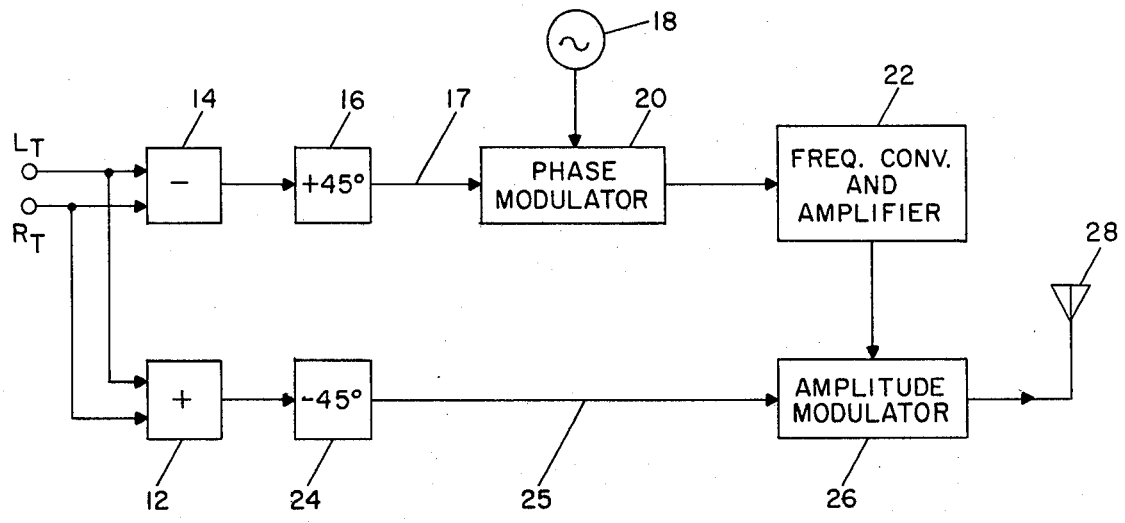
FIG. 1 (PRIOR ART)
FIG. 1 is a block diagram of a prior art transmitter for an AM stereo broadcast system of the type disclosed in the inventor's U.S. Pat. No. 3,218,393.
Figure 2:
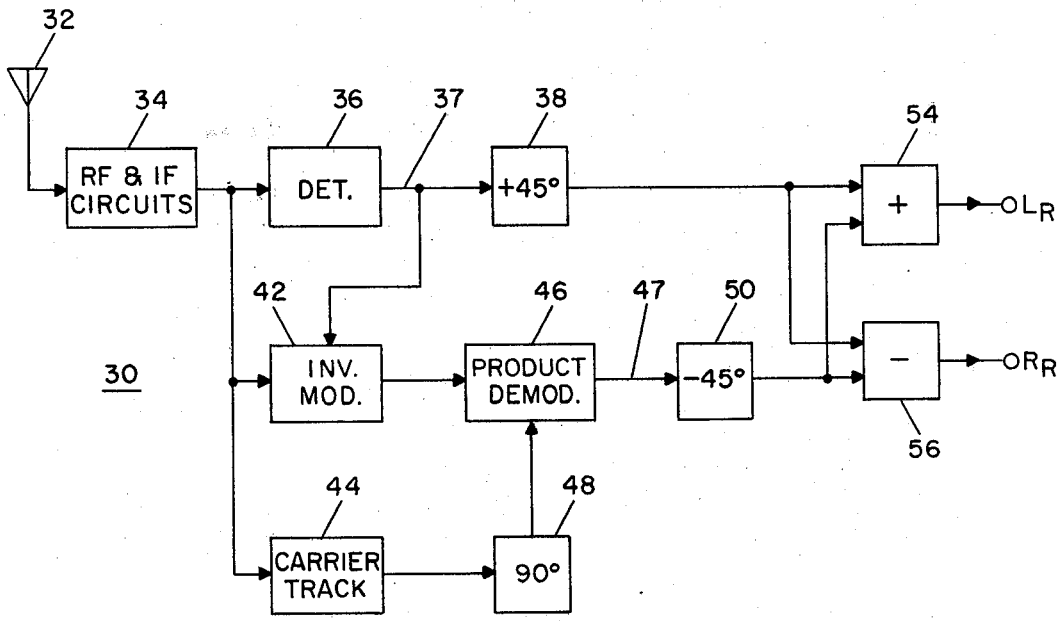
FIG. 2 (PRIOR ART)
FIG. 2 is a block diagram of a prior art AM stereo receiver of the type disclosed in the inventor's U.S. Pat. No. 4,018,994.

FIGS. 1 and 2 are block diagrams illustrating a transmitter 10 and a receiver 30, respectively, for use in an AM stereo radio broadcasting system in accordance with the inventor's prior U.S. patents mentioned hereinabove.

In the transmitter 10 of FIG. 1, separate left ($L_T$) and right ($R_T$) stereo audio signals are provided to sum circuit 12 and difference circuit 14, which develop signals representative of the sum ($L_T+R_T$) and difference ($L_T-R_T$), respectively, of the $L_T$ and $R_T$ stereo audio signals. The difference and sum signals are provided to respective phase shift circuits 16 and 24 wherein the signals undergo relative differential phase shifts of plus and minus 45°. As a result, the first and second modulating signals provided on connecting lines 17 and 25, respectively, are in quadrature phase with respect to each other. The first modulating signal ($L_T-R_T$) is provided along connecting line 17 to phase modulator 20 which modulates the carrier signal output from oscillator 18. Usually, the phase modulation of the carrier signal is carried out at a selected, relatively low first carrier frequency, and the phase-modulated carrier is frequency converted and amplified in circuitry 22, which is well-known to those skilled in the art.

The second modulating signal ($L_T+R_T$) is provided along line 25 to amplitude modulator 26, which amplitude modulates the phase-modulated carrier signal to provide an output composite signal to transmitting antenna 28 having phase modulation according to the first modulating signal (representing stereo difference information) and amplitude modulation according to the second modulating signal (representing stereo sum information). Those skilled in the art will recognize that additional amplification may be provided between amplitude modulator 26 and antenna 28. The signal transmitted from antenna 28 is a composite independent sideband (ISB) AM stereo signal of the type disclosed in the inventor's prior U.S. Pat. No. 3,218,393.

The composite signal broadcast from the transmitter 10 of FIG. 1 can be received by a conventional AM monophonic radio receiver, which detects the signal envelope, including upper and lower sidebands, to develop an output audio signal representative of stereo sum information (L+R). A pair of conventional AM receivers which are tuned to slightly higher and lower frequencies than the carrier signal will receive predominantly right and left stereo information, respectively, and thereby provide a simplified form of stereo reception. However, a preferred form of AM stereo receiver 30 which separately demodulates the amplitude and phase modulation of the transmitted composite signal and uses the demodulated signals to derive the left and right stereo signals is shown in FIG. 2.

Receiver 30 includes an antenna 32, for receiving the transmitted composite signal, and RF and IF circuitry 34, of conventional design, which converts the received composite signal to a suitable intermediate frequency. The intermediate frequency composite signal is provided to envelope detector 36 whose output is a signal ($L_R+R_R$) which is representative of the second modulating signal ($L_T+R_T$) that was provided to amplitude modulator 26 on interconnecting line 25 in the FIG. 1 transmitter. The output signal from detector 36 is provided to phase shift network 38, which effectively compensates for the original phase shift introduced by network 24 in FIG. 1. The resulting phase-shifted stereo sum signal is then provided to sum and difference circuits 54 and 56.

In the prior art AM stereo receiver of FIG. 2, the received intermediate frequency composite signal is also provided to carrier track circuit 44, of the type disclosed in the inventor's U.S. Pat. Nos. 4,018,994 and 3,973,203, in which the original carrier signal can be regenerated for use in demodulating the intermediate frequency signal. The intermediate frequency composite signal is also provided to inverse modulator 42 for the purpose of distortion reduction in accordance with the inventor's U.S. Pat. No. 4,018,994. The intermediate frequency composite signal is inversely amplitude modulated with the output signal from envelope detector 36 to form an intermediate signal which is supplied to product demodulator 46 in conjunction with the regenerated carrier signal from carrier track circuit 44, which has been phase shifted by 90° in phase shift circuit 48. Product demodulator 46 responds to the intermediate signal and the regenerated phase-shifted carrier signal to demodulate the quadrature component of the intermediate signal and provide an output signal ($L_R-R_R$), on connecting line 47, which is representative of the first modulating signal ($L_T-R_T$) that was provided to phase modulator 20 on interconnecting line 17 in the FIG. 1 transmitter. This stereo difference signal is phase shifted in phase shift network 50 and supplied to the other input of sum and difference circuits 54 and 56 to develop $L_R$ and $R_R$ output signals which are representative of the original $L_T$ and $R_T$ input stereo audio signals which were applied to the transmitter of FIG. 1.

The simplified transmitter of FIG. 1 includes no mechanism for compensation for undesired second order components which arise from amplitude modulation of the phase-modulated signal in amplitude modulator 26. This effect produces systematic error components in the (L−R) channel of stereo receivers such as that shown in FIG. 2. In accordance with the inventor's prior U.S. Pat. No. 3,908,090 circuits may be provided in the transmitter to reduce the undesired second order components. Furthermore, the inverse modulation circuit 42 is provided in the receiver of FIG. 2 for partially compensating for certain distortion components which arise due to the multiplicative nature of the transmitter (PM followed by AM).

Even though such prior art correction circuits are provided in the transmitter and the receiver, there remain systematic error components in the demodulated output signal of the stereo difference signal channel of receiver 30 in FIG. 2. In addition to the error components which result from the amplitude modulation of a phase-modulated signal in the transmitter, additional systematic error components arise from quadrature detection of the phase modulation component of the received signal in the L−R channel of the receiver. Product demodulator 46 responds to a quadrature phase reference carrier, which is regenerated in carrier track circuit 44 and phase shifted in circuit 48, and detects the portion of the intermediate signal from inverse modulator 42 which is in-phase with the quadrature-phase regenerated carrier. Thus, product demodulator 46 acts as a quadrature synchronous detector and detects the quadrature phase component of the intermediate signal. It is well known that the quadrature phase component of a phase modulated signal is representative of the sine of the phase modulation angle rather than the phase modulation angle itself. Thus, systematic errors arise from the use of a quadrature detector for detecting the phase modulation component of the received composite signal in an AM stereo receiver of the type shown in FIG. 2.

However, in accordance with the present invention an AM stereo transmitter can be modified to provide compensation of the phase modulating signal so as to correct for the systematic errors which are inherent in quadrature detection of the phase modulation component in an AM stereo receiver, as well as those which result from amplitude modulating a phase-modulated signal in the transmitter. In accordance with one aspect of the present invention such compensation is provided by means of a novel distortion predictive feedback technique, as illustrated by the AM stereo transmitter of FIG. 3.

Figure 3:
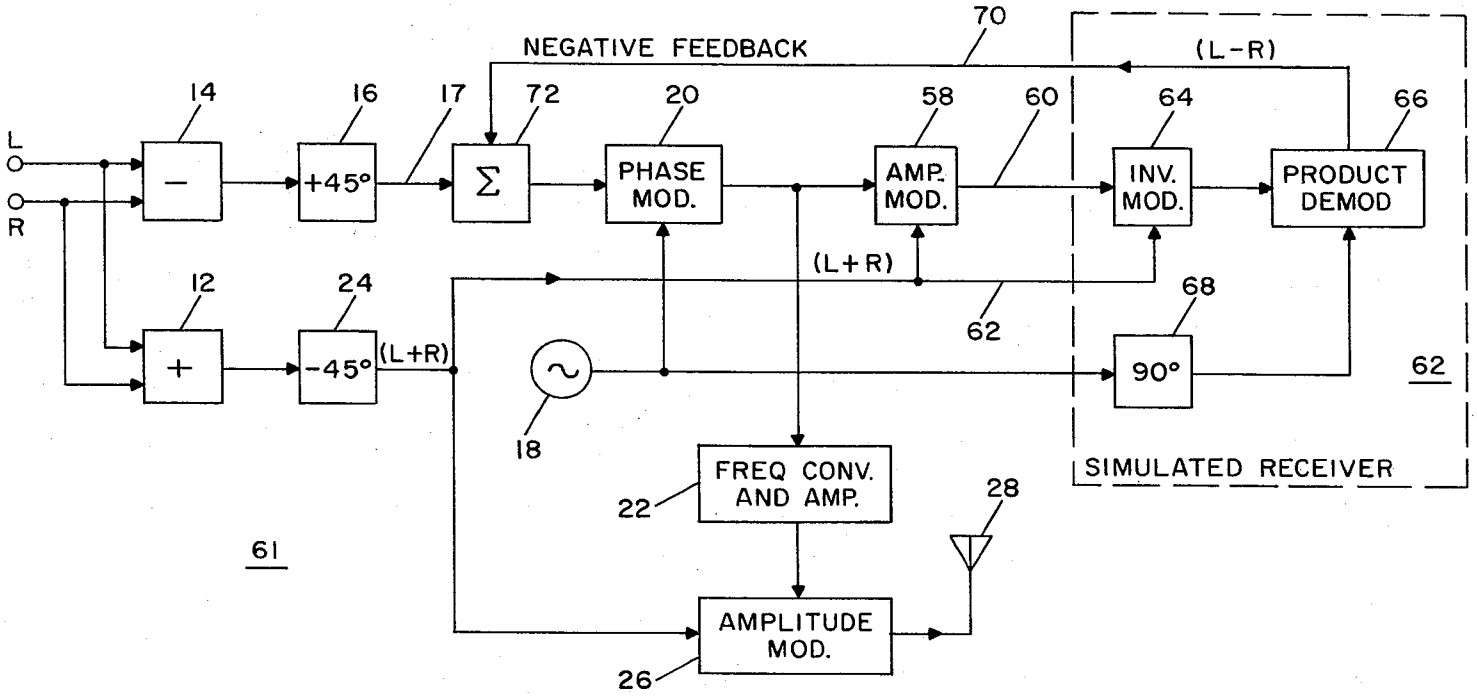
FIG. 3 is a block diagram of a transmitter for an AM stereo system in accordance with the present invention.

Transmitter 61 shown in FIG. 3 includes sum and difference circuits 12 and 14 as well as phase shift networks 16 and 24, which may be identical to those provided in the prior art transmitter 10 shown in FIG. 1. In transmitter 61 of FIG. 3, phase modulator 20 is provided with a modulating signal which is combination of the phase-shifted stereo difference signal ($L_T-R_T$) from phase shift network 16 and a negative feedback signal, which is combined with the phase-shifted stereo difference signal in sum circuit 72. The output of phase modulator 20 is supplied to one input of amplitude modulator 26 via frequency converter and amplifier 22 in the same manner as the output of phase modulator 20 in the transmitter 10 of FIG. 1. Therefore, the principal difference in the transmitter 61 of FIG. 3 is the provision of a negative feedback signal on interconnecting line 70 to combining circuit 72 for combination with the phase-shifted stereo difference signal prior to phase modulation of the carrier.

In transmitter 61, phase modulation of the carrier takes place at a first selected lower carrier frequency, which is the frequency of oscillator 18. The phase-modulated signal is then up-converted in frequency converter circuit 22 to the broadcast carrier frequency. The phase-modulated signal from modulator 20 is additionally supplied to amplitude modulator 58, which is also supplied with the phase-shifted stereo sum signal ($L_T+R_T$) from phase shift network 24. The phase-modulated signal from phase modulator 20 is then amplitude modulated in modulator 58 to generate on interconnecting line 60 a lower carrier frequency signal which is both phase and amplitude modulated, and which simulates the higher carrier frequency composite signal transmitted by antenna. The signal on line 60 is inversely amplitude modulated in inverse modulator 64 with the phase-shifted stereo sum signal, available on line 62, in a manner which simulates the operation of inverse modulator 42 of the prior art receiver 30 in FIG. 2. The output of inverse modulator 64 is provided to product demodulator 66 where it is quadrature demodulated, using a 90° phase shifted carrier signal from oscillator 18 as a reference, to develop a feedback signal on line 70 which is representative of the stereo difference signal which would be generated by the product demodulator 46 of a receiver of the type shown in FIG. 2 in response to the composite signal transmitted by antenna 28. Thus, elements 64, 66 and 68 may be characterised as comprising a "simulated receiver" 62 which predicts the effects which an actual receiver, such as that of FIG. 2, will produce in the reception and demodulation of the broadcast ISB AM stereo signal. Similarly, amplitude modulator 58 simulates the effects produced by final amplitude modulator 26 in FIG. 3.

The output signal on interconnecting line 70 in FIG. 3 is provided as negative feedback to combining circuit 72 for combination with the stereo difference signal supplied from phase shift network 16. The negative feedback signal represents a combination of the phase modulating stereo difference signal and systematic error components which result from the operation of the modulating and demodulating components of the overall system. Using this signal as negative feedback reduces the systematic error components in the final composite signal transmitted by antenna 28 in FIG. 3.

In view of the improvement which results from incorporation of the distortion predictive negative feedback arrangement in the transmitter of FIG. 3, it is possible to provide a reduction in the systematic error components which will appear in the output of an ISB AM stereo receiver of the type shown in FIG. 2. The use of a simulated transmitter and receiver in the L−R channel of the transmitter of FIG. 3 enables the feedback circuitry to develop an accurate prediction of the error components which may be produced in the L−R channel of a typical ISB stereo receiver, and thereby to compensate the phase modulating signal so as to reduce such system errors.

Although the distortion predictive feedback technique disclosed in FIG. 3 is capable of reducing distortion in an AM stereo system, an alternative technique for distortion reduction is particularly advantageous when used in combination with the feedback technique. In particular, distortion reduction also can be accomplished by applying a subtractive distortion reduction technique prior to phase modulator 20 in FIG. 1. Suitable subtractive distortion reduction circuitry which also relies on distortion prediction is shown in FIG. 5, and may be used in combination with the feedback technique shown in FIG. 4.

Figure 4:
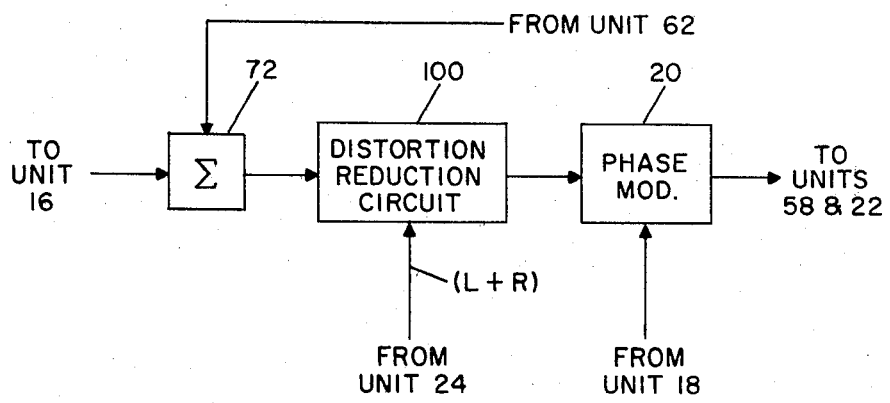
FIGS. 4 and 5 are block diagrams of an alternative transmitter in accordance with the present invention.
Figure 5:
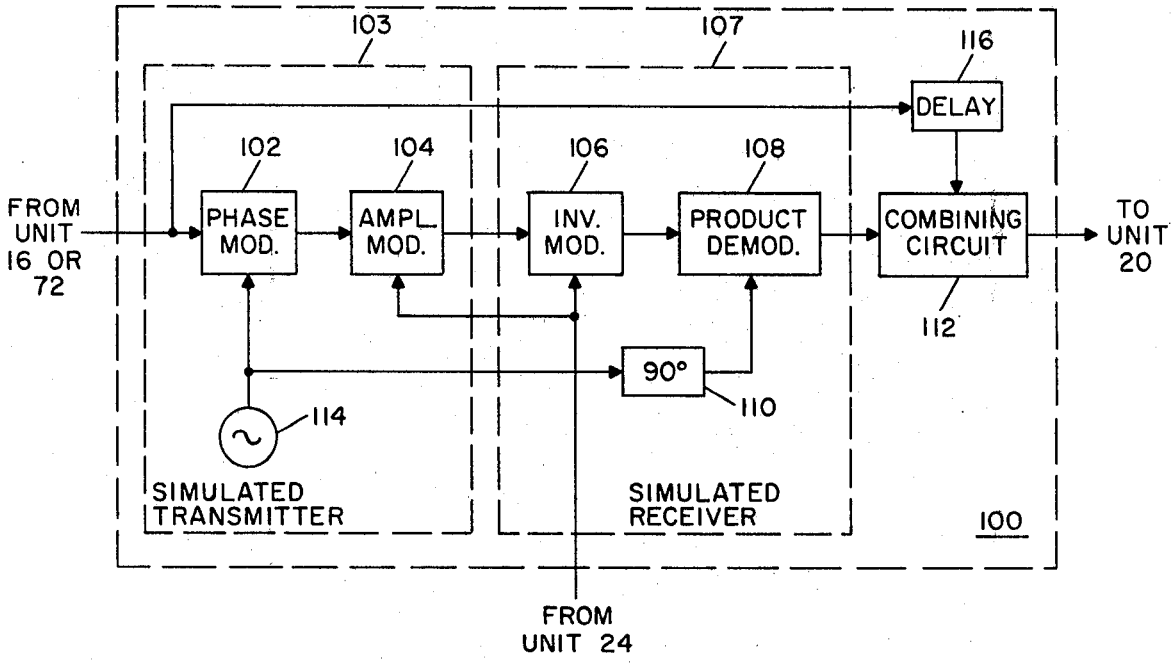

The subtractive distortion reduction technique disclosed in FIGS. 4 and 5 relies on the development of a signal which represents a prediction of the distortion components which will exist in the L−R output of an AM stereo receiver of a type which would be utilized with the transmitter shown in FIG. 1. A typical prior art receiver configuration is shown in FIG. 2.

As shown in FIG. 5 distortion reduction circuit 100 incorporates a simulated transmitter 103 and a simulated receiver 107 together with delay network 116 and combining circuit 112. As shown, the input signal to distortion reduction circuit 100 may come either from phase shift network 16 in FIG. 1 or from combining circuit 72 in FIG. 4. The signal applied to the input of circuit 100 phase modulates a carrier from reference oscillator 114. The resulting signal is amplitude modulated with (L+R) information and then is demodulated in simulated receiver 107. Simultaneously, the input signal is bypassed around simulated transmitter 103 and simulated receiver 107, delay compensated in delay network 116 and applied to combining circuit 112. The output signal from simulated receiver 107 in the ideal case would be identical to the input signal applied to circuit 100 and, therefore, identical to the signal applied to the combining circuit 112. For example, if the signal supplied to combining circuit 112 from delay network 116 is equal to 2(L−R), and the signal from simulated receiver 107 is equal to (L−R), then if the latter is subtracted from the former in combining circuit 112 the output signal will simply be equal to (L−R). However, to the extent that transmission and reception of that signal (as simulated by units 103 and 107) introduces distortion, the signal applied to combining circuit 112 from simulated receiver 107 will contain distortion components. By subtractively combining the two signals in combining circuit 112, the distortion components can be introduced into the resulting signal in such a way that they will tend to cancel the distortion components which subsequently arise as the resulting signal is then processed by the actual transmitter, transmitted, received and processed by an actual receiver. The result at the output of an actual receiver will be a reduction in the distortion components which would otherwise exist if the signal at the transmitter has not been processed by the predictive distortion reduction circuit 100.

Referring to FIG. 5, simulated transmitter 103 comprises a phase modulator 102 followed by an amplitude modulator 104, with phase modulator 102 being driven by reference oscillator 114. It will be recognized that this combination operates in the same manner as units 18, 20 and 26 of the prior art transmitter shown in FIG. 1. Likewise, simulated receiver 107 in FIG. 5 comprises inverse modulator 106 and product demodulator 108, with inverse modulator 106 being controlled by the $(L_T+R_T)$ signal available from the output of phase shift network 24 in the FIG. 1 or FIG. 3 transmitter embodiments, for example. Product demodulator 108 is driven by the output of reference oscillator 114, which has been phase shifted by 90 in phase shift network 110. It will be recognized that these units function in the same manner as units 42 and 46 in the prior art receiver shown in FIG. 2.

From the above discussion of the arrangement shown in FIG. 5 it can be seen that distortion reduction can be accomplished in a transmitter without the use of feedback by utilizing the subtractive form of distortion reduction circuitry shown, whereby the input stereo difference signal $(L_T-R_T)$ is processed by a simulated transmitter and receiver so as to develop a signal which simulates the stereo difference signal which will be developed at the output of the L−R channel of an actual receiver. If the signal from simulated receiver 107 contains any distortion components, then by subtractively combining that signal with the delay-compensated original input signal $(L_T-R_T)$ in combining circuit 112, a resultant ($L_T-R_T$) signal can be developed containing negative distortion components which will tend to cancel the distortion components which are introduced as a result of actual transmission and reception. As a result, the ($L_R-R_R$) signal developed at the stereo difference output of an actual AM stereo receiver, such as of the type shown in FIG. 2, will have lower distortion than would be the case if a prior art transmitter were used.

As noted hereinabove, the subtractive distortion reduction technique shown in FIG. 5 and the feedback distortion reduction technique shown in FIG. 3 are particularly advantageous when utilized in combination as shown in FIG. 4. When the feedback technique is utilized alone, as shown in FIG. 3, the amount of feedback required to produce a desired amount of distortion reduction may be such as to tend to produce instability in the feedback loop under certain conditions. By introducing subtractive distortion reduction circuit 100 prior to the point which feeds the feedback loop, as shown in FIG. 4, the distortion reduction function is shared by the subtractive technique and the feedback technique. As a result, a lesser amount of feedback is required in order to produce any desired amount of distortion reduction than would be the case if the feedback techniques were used alone, thus greater amounts of distortion reduction can be achieved while using a reasonable level of feedback in the feedback loop, thereby insuring stability of the feedback loop.

Although the present invention has been described in relation to an independent sideband form of AM stereo system, the predictive feedback and subtractive distortion reduction techniques herein disclosed may be applied in transmitters for other forms of AM stereo radio bradcasting, as will be apparent to those skilled in the art.

While there have been described what are presently considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. In apparatus for generating a composite AM stereo radio broadcast signal comprising a main carrier signal amplitude modulated with stereo sum information and angle modulated with stereo difference information, the improvement comprising:

means, including a simulated stereo receiver, for developing at the output of said simulated receiver a signal representing a prediction of the distortion which may arise from the transmission and reception of said composite signal and the demodulation of the angle-modulation component thereof;

and means for directly combining said predictive signal with a supplied stereo difference information bearing signal, to produce a modified stereo difference information bearing signal, for use in angle modulating a secondary carrier which is related to said main carrier, thereby to reduce said distortion.

2. Apparatus in accordance with claim 1 wherein said combining means combines said predictive signal and said stereo difference information bearing signal in accordance with a predetermined mathematical function.

3. Apparatus in accordance with claim 2 wherein said predictive signal developing means includes means for simulating the transmission and reception of said composite signal and the demodulation of the angle-modulation thereof, thereby to develop said predictive signal.

4. Apparatus in accordance with claim 3 and having a first stereo difference information bearing signal supplied thereto, wherein said predictive signal developing means is responsive to said first signal and wherein said modified stereo difference information bearing signal is utilized directly to angle modulate said secondary carrier.

5. Apparatus in accordance with claim 4 and having a first stereo sum information bearing signal supplied thereto, wherein said predictive signal developing means is also responsive to said first stereo sum information bearing signal, and said transmission simulating means comprises means for angle modulating a supplied carrier signal with said first stereo difference information bearing signal and means for modulating said angle-modulated carrier with said first stereo sum information bearing signal, thereby to develop a simulated composite AM stereo broadcast signal for demodulation in said simulated receiver.

6. Apparatus in accordance with claim 5 wherein said simulated receiver comprises means, responsive to said simulated composite signal for simulating the reception and demodulation of the angle modulation component thereof, thereby to develop said predictive signal.

7. Apparatus for generating a composite AM stereo radio broadcast signal comprising:

means for supplying a first stereo sum information bearing signal and a first stereo difference information bearing signal;

means for supplying a first carrier signal;

simulated transmitter means, responsive to said first stereo sum and difference information bearing signals and said first carrier signal, for angle modulating said carrier signal with said first stereo difference information bearing signal and for amplitude modulating said angle-modulated carrier with said first stereo sum information bearing signal, thereby to develop a simulated composite AM stereo radio broadcast signal;

means for simulating the reception of said simulated signal and the demodulation of the angle-modulation component thereof, thereby to develop a signal representing a prediction of the distortion which may arise from the transmission and reception of said actual composite signal and the demodulation of the angle modulation component thereof;

means for directly combining said first stereo difference information bearing signal and said predictive signal to develop a modified stereo difference information bearing signal therefrom;

means for angle modulating a supplied second carrier signal with said modified signal;

and amplitude modulating means responsive to said angle-modulated second carrier signal and said first stereo sum information bearing signal, thereby to develop said actual composite AM stereo radio broadcast signal.

8. Apparatus in accordance with claim 3 wherein said predictive signal developing means is responsive to said angle-modulated carrier.

9. Apparatus in accordance with claim 8, wherein said predictive signal developing means is also responsive to a supplied stereo sum information bearing signal, and wherein said transmission simulating means comprises means for amplitude modulating said angle-modulated carrier with said supplied stereo sum information bearing signal, thereby to develop a simulated composite AM stereo radio broadcast signal.

10. Apparatus in accordance with claim 9 wherein said simulated receiver in said predictive signal developing means comprises means responsive to said simulated composite signal for simulating the reception and demodulation of the angle modulation component thereof, thereby to develop said predicitive signal.

11. Apparatus for generating a composite AM stereo radio broadcast signal comprising:

means for supplying a first stereo sum information bearing signal and a first stereo difference information bearing signal;

means for supplying a first carrier signal;

means for directly combining said first stereo difference information bearing signal with a supplied predictive signal to produce a modified stereo difference information bearing signal;

means for angle modulating a supplied second carrier signal with said modified signal;

amplitude modulating means responsive to said angle-modulated signal and said first stereo sum information bearing signal, for developing said actual composite AM stereo radio broadcast signal;

simulated transmitter means, responsive to said angle-modulated signal and to said first stereo sum information bearing signal, for amplitude modulating the former with the latter, thereby to develop a simulated composite AM stereo radio broadcast signal;

and means for simulating the reception of said simulated signal and the demodulation of the angle modulation component thereof to develop a signal representing a prediction of the distortion which may arise from the transmission and reception of said actual composite signal and the demodulation of the angle modulation component thereof, and for suppling said predictive signal back to an input of said combining means, thereby to reduce said distortion.

12. Apparatus in accordance with claim 8 and including a second predictive signal developing means and a second signal combining means, said second predictive signal developing means being responsive to the first modified stereo difference information bearing signal produced by said first signal combining means, for developing a second predictive signal representing a prediction of the distortion which may arise from the transmission and reception of said actual composite AM stereo radio broadcast signal and the demodulation of the angle modulation component thereof; and wherein said second signal combining means directly combines the predictive signal from said second predictive signal developing means with the first modified stereo difference information bearing signal from said first signal combining means to produce a second modified stereo difference information bearing signal for use in angle modulating said carrier signal, thereby to further reduce said distortion.

13. Apparatus in accordance with any one of the preceding claims 1–12 wherein said angle modulation is phase modulation.

* * * * *